US011689836B2

(12) United States Patent
Meyberg Guzman et al.

(10) Patent No.: US 11,689,836 B2
(45) Date of Patent: Jun. 27, 2023

(54) EARLOOP MICROPHONE

(71) Applicant: Plantronics, Inc., Santa Cruz, CA (US)

(72) Inventors: Jacob T. Meyberg Guzman, Santa Cruz, CA (US); John A. Kelley, Santa Cruz, CA (US); Nicholas W. Paterson, Aptos, CA (US); Iain McNeill, Aptos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 17/334,538

(22) Filed: May 28, 2021

(65) Prior Publication Data

US 2022/0386006 A1 Dec. 1, 2022

(51) Int. Cl.

*H04R 1/08* (2006.01)
*H04R 1/10* (2006.01)
*H04R 3/00* (2006.01)

(52) U.S. Cl.

CPC ..... *H04R 1/08* (2013.01); *H04R 1/105* (2013.01); *H04R 1/1016* (2013.01); *H04R 3/005* (2013.01)

(58) Field of Classification Search

CPC ..... H04R 1/08; H04R 1/1016; H04R 1/105; H04R 3/005
USPC ..... 381/74, 91, 122, 312
See application file for complete search history.

(56) References Cited

U.S. PATENT DOCUMENTS 5,132,940 A * 7/1992 Culbert ..... G10K 11/348 367/135
8,286,085 B1 10/2012 Denise
8,620,672 B2 12/2013 Visser et al.
8,725,838 B2 5/2014 Bezos
9,817,912 B2 11/2017 Willis et al.
9,819,313 B2 * 11/2017 Deo ..... H03G 3/3052
9,842,113 B1 12/2017 Sorvillo et al.
9,953,650 B1 4/2018 Falevsky
10,182,298 B2 1/2019 Rasmussen et al.
10,218,758 B2 2/2019 Li et al.
10,237,081 B1 3/2019 Narayanaswamy
10,460,718 B2 * 10/2019 Sibbald ..... G10K 11/17873
10,475,000 B2 11/2019 Sarrazin et al.
10,528,922 B1 1/2020 Narayanaswamy
10,567,861 B2 2/2020 Rich et al.
10,638,090 B1 4/2020 Sculley
10,664,529 B2 5/2020 Spataro et al.
10,754,526 B2 8/2020 Faulkner et al.
2011/0231409 A1 9/2011 Dhara et al.
2012/0224456 A1 9/2012 Visser et al.
2012/0317135 A1 12/2012 Jin et al.

(Continued)

FOREIGN PATENT DOCUMENTS

WO 2018/102239 A1 6/2018

OTHER PUBLICATIONS

JLAB, Epic Air Sport, Mar. 2021.*

(Continued)

*Primary Examiner* — William A Jerez Lora
(74) *Attorney, Agent, or Firm* — Quarles & Brady LLP

(57) ABSTRACT

A headset implements an earloop microphone and includes a housing. An earloop of the headset secures the headset to an ear of a user. A first microphone is acoustically coupled to a first opening in the housing. A second microphone is acoustically coupled to a second opening in the housing. A third microphone is acoustically coupled to a third opening in the earloop.

20 Claims, 6 Drawing Sheets

(56) References Cited

U.S. PATENT DOCUMENTS

| | | | | |
|---|---|---|---|---|
| 2014/0108486 | A1 | 4/2014 | Borzycki et al. | |
| 2014/0181219 | A1 | 6/2014 | Wang et al. | |
| 2014/0351336 | A1 | 11/2014 | Yeo et al. | |
| 2016/0034440 | A1 | 2/2016 | Lee | |
| 2016/0112476 | A1 | 4/2016 | Gudipaty et al. | |
| 2016/0191576 | A1 | 6/2016 | Thompson et al. | |
| 2016/0234276 | A1 | 8/2016 | Ouyang et al. | |
| 2017/0091263 | A1 | 3/2017 | Fredinburg et al. | |
| 2017/0308352 | A1* | 10/2017 | Kessler | H04R 3/005 |
| 2018/0115839 | A1* | 4/2018 | Eichfeld | G10K 11/17881 |
| 2018/0324514 | A1* | 11/2018 | Dusan | G10K 11/17879 |
| 2018/0341374 | A1 | 11/2018 | Faulkner et al. | |
| 2019/0075406 | A1 | 3/2019 | Petersen et al. | |
| 2019/0079946 | A1 | 3/2019 | Li et al. | |
| 2019/0179501 | A1 | 6/2019 | Seeley et al. | |
| 2019/0266573 | A1 | 8/2019 | Radhakrishnan et al. | |
| 2019/0272141 | A1 | 9/2019 | Poel et al. | |
| 2019/0288968 | A1 | 9/2019 | Chilakamarri et al. | |
| 2019/0339822 | A1 | 11/2019 | Devine et al. | |
| 2020/0073934 | A1 | 3/2020 | Brunn et al. | |
| 2020/0107137 | A1* | 4/2020 | Koutrouli | H04R 25/405 |
| 2020/0145240 | A1 | 5/2020 | Jaber et al. | |
| 2020/0250245 | A1 | 8/2020 | Abhyankar et al. | |
| 2021/0014287 | A1 | 1/2021 | Kimball et al. | |
| 2021/0026897 | A1 | 1/2021 | Rathje et al. | |
| 2021/0029443 | A1* | 1/2021 | Liu | H04R 29/005 |
| 2021/0144469 | A1* | 5/2021 | Zhao | H04R 1/1075 |
| 2021/0232542 | A1 | 7/2021 | Dhanabalan et al. | |
| 2021/0377672 | A1* | 12/2021 | Grinnip, III | H04R 1/1008 |
| 2022/0067106 | A1 | 3/2022 | Saez et al. | |
| 2022/0261760 | A1 | 8/2022 | Cupala et al. | |

OTHER PUBLICATIONS

JLab. com, "Epic Air Sport ANC True Wireless Earbuds", retrieved from the Internet May 26, 2021 (6 pages) <https://www.jlab.com/products/epic-air-sport-anc-true-wireless-earbuds>.

European Application No. 22172773, Search Report, dated Oct. 18, 2022.

* cited by examiner

EARLOOP MICROPHONE

BACKGROUND

Earbuds transmit and receive sound signals, convert sound signals to electromagnetic signals, and transmit and receive electromagnetic signals. A challenge is to reduce the size and weight of the earbud while enhancing the transmission and reception characteristics of the sound and electromagnetic signals.

SUMMARY

In general, in one aspect, one or more embodiments relate to a method that uses an earloop microphone. A first audio signal is received from a first microphone acoustically coupled to a first opening in a headset. A second audio signal is received from a second microphone acoustically coupled to a second opening in the headset. The second opening and the first opening are separated by a first spacing. The first spacing creates first phase and amplitude differences between the second audio signal and the first audio signal. A third audio signal is received from a third microphone acoustically coupled to a third opening in an earloop of the headset. The third opening and the second opening are separated by a second spacing. The second spacing creates second phase and amplitude differences between the third audio signal and the first audio signal. A source signal is identified using the first phase and amplitude differences and the second phase and amplitude differences. A gain is applied to amplify the source signal.

In general, in one aspect, one or more embodiments relate to an apparatus that includes an earloop, a processor, a memory connected to the processor, a first microphone acoustically coupled to a first opening, a second microphone acoustically coupled to a second opening, a third microphone acoustically coupled to a third opening in the earloop, and program code stored on the memory that is executed by the processor. A first audio signal is received from a first microphone acoustically coupled to a first opening in a headset. A second audio signal is received from a second microphone acoustically coupled to a second opening in the headset. The second opening and the first opening are separated by a first spacing. The first spacing creates first phase and amplitude differences between the second audio signal and the first audio signal. A third audio signal is received from a third microphone acoustically coupled to a third opening in an earloop of the headset. The third opening and the second opening are separated by a second spacing. The second spacing creates second phase and amplitude differences between the third audio signal and the first audio signal. A source signal is identified using the first phase and amplitude differences and the second phase and amplitude differences. A gain is applied to amplify the source signal.

In general, in one aspect, one or more embodiments relate to a headset that implements an earloop microphone and includes a housing. An earloop of the headset secures the headset to an ear of a user. A first microphone is acoustically coupled to a first opening in the housing. A second microphone is acoustically coupled to a second opening in the housing. A third microphone is acoustically coupled to a third opening in the earloop.

Other aspects of the invention will be apparent from the following description and the appended claims.

DETAILED DESCRIPTION

Figure 1A:
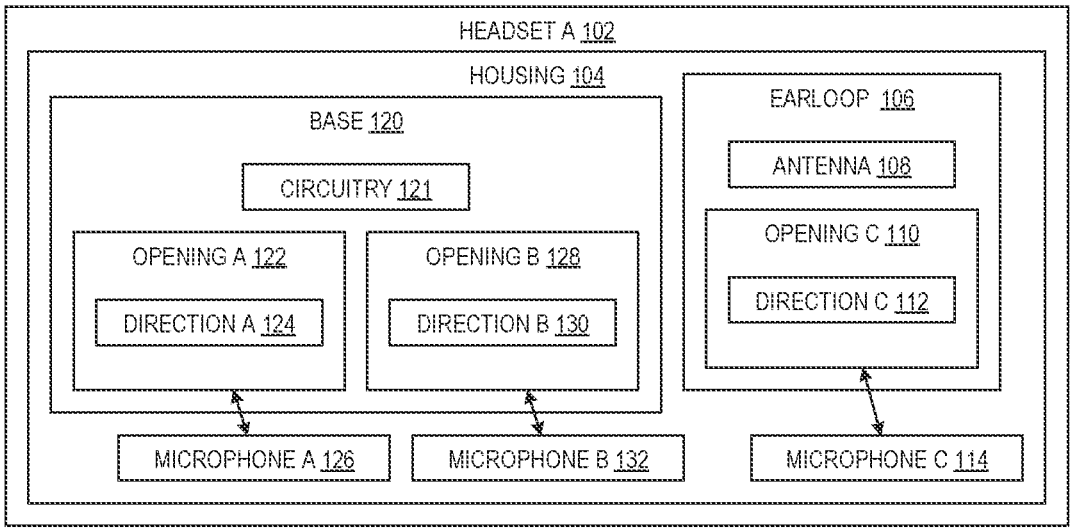
FIG. 1A and FIG. 1B show diagrams of systems in accordance with disclosed embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, one or more embodiments of the disclosure reduce the size and weight of the earbuds while enhancing the transmission and reception characteristics of the sound and electromagnetic signals with an earloop microphone. A microphone, of a microphone array, is placed in the earloop of an earbud to increase the spacing between the microphones.

Increased spacing between the microphones increases the phase and amplitude differences between sound signals from the same sound source. The phase and amplitude differences may be used by sound source identification algorithms and beamforming algorithms to amplify (apply a gain) to sound signals from a particular source, e.g., the user of the earbuds.

The phase difference between two audio signals, generated from a sound signal of a sound source, is the difference between a reference point that occurs in both of the audio signals. The phase difference between the two audio signals identifies how much the sound signal captured in one audio signal is shifted in time with respect to the sound signal captured in the other audio signal. The phase difference may be measured in radians or degrees. The amplitude difference between two audio signals is the difference between the extreme values (e.g., peak values) of the audio signals.

Embodiments of the disclosure may also locate an antenna in the earloop of the earbud. The antenna may be colocated with or connected to the structures of the microphone in the earloop. The antenna may be part of a set of antennas used by the earbud to communicate with a media device for interactive voice communication with the user of the earbud.

Figure 1B:
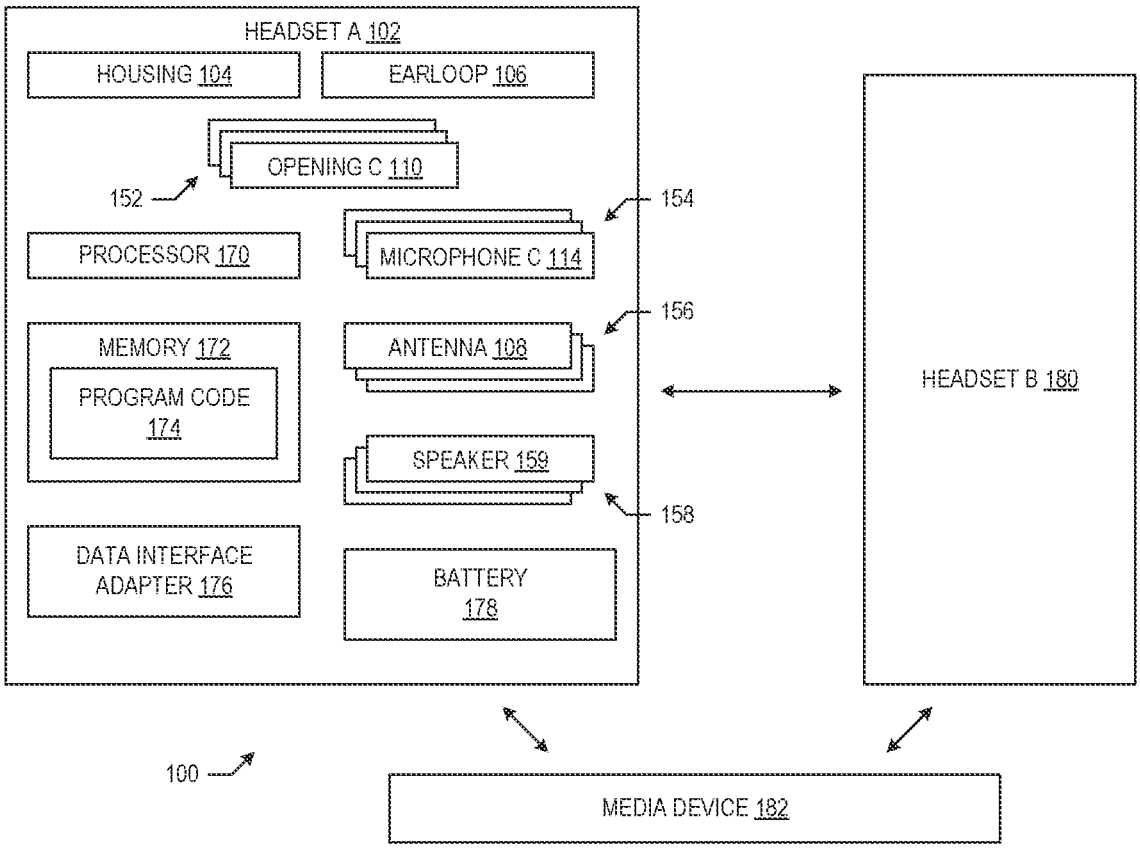

FIG. 1A and FIG. 1B show diagrams of systems that are in accordance with the disclosure. FIG. 1A shows the headset A (102) that includes a microphone coupled with an earloop. FIG. 1B shows a diagram of the system (100) that includes the headset A (102). The embodiments of FIG. 1A and FIG. 1B may be combined and may include or be included within the features and embodiments described in the other figures of the application. The features and elements of FIG. 1A and FIG. 1B are, individually and as a combination, improvements to the technology of headsets. The various elements, systems, and components shown in FIG. 1A and FIG. 1B may be omitted, repeated, combined, and/or altered as shown from FIG. 1A and FIG. 1B. Accordingly, the scope of the present disclosure should not be considered limited to the specific arrangements shown in FIG. 1A and FIG. 1B.

Turning to FIG. 1A, the headset A (102) is a personal audio device for use with an ear of the user that provides audio to a user using wired or wireless connections. The headset A (102) receives sound signals that are captured and converted to audio signals using the microphones A (126), B (132), and C (114). The sound signals may be transmitted to other devices (e.g., as part of an interactive voice conversation and/or a recording). Additionally, the headset A (102) receives data (wired or wirelessly) and generates audible sound waves as a sound signal that can be heard by a user wearing the headset A (102), such as by using one or more speakers (not shown). As an example, the headset A (102) may be an earbud configured to be affixed to an ear of a user. The headset A (102) includes the housing (104), which includes the earloop (106), the base (120), and the microphones A (126), B (132), and C (114).

The earloop (106) is a part of the housing (104) that extends from the base (120) and wraps behind the cartilage of the ear of the user. The earloop (106) may wrap behind the helix of the ear of the user. The earloop (106) fits between the head of the user and the ear and secures the headset A (102) to the user. The earloop (106) includes the antenna (108) and the opening C (110). In one embodiment, the earloop (106) is formed as part of, and is an extension to, the base (120). The cross-sectional thickness of the earloop (106), in the dimension perpendicular to the skull of the user, may be about 1.5 millimeters. In additional embodiments, the cross-sectional thickness may range from about 1 millimeter to about 8 millimeters.

The antenna (108) is located in the earloop (106). The antenna (108) connects to the circuitry (121) in the headset A (102), e.g., the data interface adapter (176) (of FIG. 1B). The antenna (108) sends and receives electromagnetic signals to and from the headset A (102) to a connected device (not shown).

The opening C (110) is located on the earloop (106). In general, an opening is one or more holes in the housing that allow for the passage of sound signals. The opening C (110) allows sound signals (acoustic waves) to reach the microphone C (114). The opening C (110) is formed with the direction C (112), which points in a direction perpendicular to a plane formed by the opening C (110). In one embodiment, the other directions A (124) and B (130) of the openings A (122) and B (128) may be different from the direction C (112) of the opening C (110).

The microphone C (114) is acoustically coupled to the opening C (110). The microphone C (114) may be located in the earloop (106). In one embodiment, the microphone C (114) may be located in the base (120) and acoustically coupled to the opening C (110) through an acoustic waveguide (e.g., a cavity) extending from the base (120) into the earloop (106) to the opening C (110).

The base (120) is part of the housing (104) that includes the openings A (122) and B (128) and contains other components of the headset A (102), including the circuitry (121). The circuitry (121) includes the electronic components of the headset A (102), which includes, from FIG. 1B, the processor (170), the memory (172), the data interface adapter (176), the battery (178), etc.

The openings A (122) and B (128) are located at different positions on the base (120). In one embodiment the openings A (122) and B (128) are at least about 20 millimeters apart. The openings A (122) and B (128) are respectively formed with the directions A (124) and B (130), which point in directions perpendicular to planes formed by the openings A (122) and B (128). In one embodiment, the directions A (124) and B (130) may be different from each other without affecting the phase and amplitude differences in the signals captured by the microphones A (126) and B (132). In one embodiment, the microphone pair axis that passes through the centers of the openings A (122) and B (128) may point towards the mouth of the user.

The microphones A (126) and B (132) are acoustically coupled to the openings A (122) and B (128). In one embodiment, the microphones A (126) and B (132) may be colocated with the openings A (122) and B (128) in the base (120). One or both of the microphones A (126) and B (132) may also be acoustically coupled to the openings A (122) and B (128) with acoustic waveguides to separate the microphones A (126) and B (132) away from the location of the openings A (122) and B (128).

Turning to FIG. 1B, the system (100) sends and receives sound signals to a user of the system (100). The system (100) includes the headset A (102), the headset B (180), and the media device (182). In one embodiment, the headsets A (102) and B (180) are wireless earbuds and the media device (182) is a mobile device. The headsets A (102) and B (180) play audio, from the media device (182), through speakers and capture audio, sent to the media device (182), through microphones.

The headset A (102) includes several components to send and receive sound signals, data signals, electromagnetic signals, etc. The headset A (102) may be an embedded device as described below with reference to the computing system (800) of FIG. 8. The headset A (102) sends and receives data signals to and from the media device (182) and the headset B (180) using the data interface adapter (176) in conjunction with the antennas (156). The headset A (102) sends and receives sound signals to the user of the system (100) using the speakers (158) and the microphones (154). In one embodiment, the headset A (102) is an earbud wirelessly connected to the media device (182) for interactive voice communication between the user of the system (100) and another participant in the interactive voice communication.

The housing (104) of the headset A (102) covers the components of the headset A (102). In one embodiment, the earloop (106) is integrally formed as a part of the housing (104). The housing (104) may be shaped to fit a left ear or a right ear of the user.

The earloop (106) secures the headset A (102) to the user by looping around the cartilage of the ear of the user. In one embodiment, the earloop (106) includes the opening C (110), the microphone C (114), and the antenna (108).

The openings (152) include the openings A (122) (of FIG. 1A), B (128) (of FIG. 1A), and C (110). The opening allows the propagation medium of the sound signals (i.e., air) to reach inside the headset A (102) to the microphones (154). The openings (152) are acoustically coupled to the microphones (154).

The microphones (154) include the microphones A (126) (of FIG. 1A), B (132) (of FIG. 1A), and (114). Embodiments may include more than three microphones. The microphones (154) convert sound signals to audio signals (e.g., digital or analog electrical signals), which are data signals that are sent to the processor (170). Audio signals are electronic representations of sound signals that propagate in air. The sound signals include speech from speakers near the headset A (102) and background noise.

The antennas (156) include the antenna (108). The antennas (156) convert between free space electromagnetic signals and electrical signals in the headset (102). Electromagnetic signals propagate through the space around the headset A (102) and the electrical signals (also referred to as data signals) propagate between the processor (170) and the antennas (156) using the data interface adapter (176). The signal reception and transmission allows data communications to be sent to and received from the headset A (102).

The speakers (158) include the speaker (159). The speakers (158) generate the sound signals that are transmitted to the ear of the user from the audio signals generated by the processor (170).

The processor (170) is a set of one or more processors that receives, processes, and transmits data using electrical signals between the components of the headset A (102). The processor (170) may include one or more embedded processors, digital signal processors (DSPs), systems on chip (SoCs), etc. The processor (170) reads instructions from the memory (172) to process the signals received from the microphones (154) and antennas (156) and generate signals transmitted by the speakers (158) and the antennas (156). In one embodiment, the processor (170) executes instructions from the memory to receive audio signals from the microphones (154), identify a source signal from the audio signals using phase and amplitude differences between the audio signals, and applies a gain to amplify the source signal.

The memory (172) is a set of one or more memories that stores data and instructions captured and used by the headset A (102), including the program code (174). The program code (174) includes the instructions for converting the sound signals from the microphones (154) to audio signals, converting electromagnetic signals from and to the antennas (156) to data signals, and converting data signals to audio signals sent to the speakers (158).

In one embodiment, the program code (174) includes programs for locating sound signal sources (e.g., the user of the headset A (102)) and amplifying selected sound signals from selected sources. For example, with execution of the program code (174) by the processor (170), the headset A (102) may amplify the speech of the user of the headset A (102) by about 20 decibels (dB). The amplification is generated by processing the data signals converted from the sound signals received from the microphones (154) through the openings (152). The spacing between the openings (152) (and the microphones (154)) sense phase and amplitude differences in the sound signals for the sources of the sounds in the sound signals. The phase and amplitude differences are used to identify the source of the sounds and selectively amplify the sound of the speech of the user of the system (100).

The data interface adapter (176) includes components and protocols that transmit and receive data signals to and from the headset A (102). In one embodiment, the data interface adapter (176) includes the antenna (108) and uses a protocol for a personal area network to send and receive data between the headset A (102), the headset B (180), and the media device (182). Through the data interface adapter (176), the headset A (102) may receive data signals from the headset B (180) that correspond to sound signals from the microphones of the headset B (180). The sound signals from the headset B (180) may be used in conjunction with the sound signals from the headset A (102) by the program code (174) to identify and amplify the speech of the user.

The battery (178) is a source of energy. The battery (178) provides electrical power to the components of the headset A (102).

The headset B (180) is complimentary to the headset A (102) and may be configured for the other ear of the user of the system (100). For example, the headset A (102) may be configured for the left ear of the user and the headset B (180) may be configured for the right ear of the user. The hardware and software components and structure may be similar to that of the headset A (102).

The media device (182) includes a computing system, as described in FIG. 8 below, that sends and receives data signals with the headset A (102) and the headset B (180). For example, the media device (182) may be a mobile phone, a tablet computer, a laptop computer, etc. The media device (182) may connect with other devices through communication networks to provide interactive voice communications using the system (100).

Figure 2:
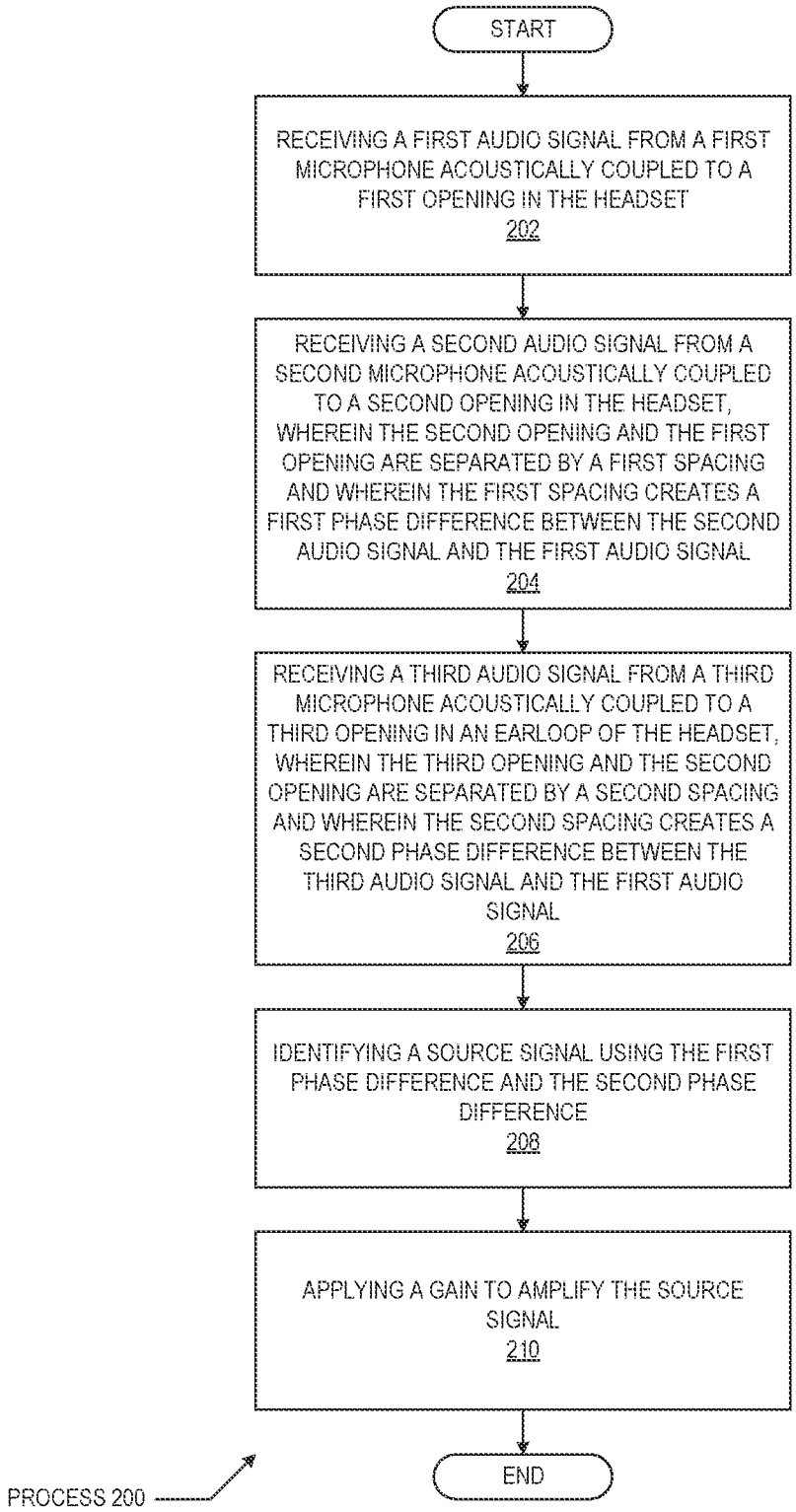
FIG. 2 shows a flowchart in accordance with disclosed embodiments.

FIG. 2 shows a flowchart of methods in accordance with one or more embodiments of the disclosure. The process (200) uses a microphone on an earloop to receive audio signals. While the various steps in the flowcharts are presented and described sequentially, one of ordinary skill will appreciate that at least some of the steps may be executed in different orders, may be combined or omitted, and at least some of the steps may be executed in parallel. For example, Blocks 202-206 may be performed concurrently. Similarly, Blocks 208 and 210 may be performed as audio signals are received.

Turning to FIG. 2, in Block 202, a first audio signal is received from a first microphone acoustically coupled to a first opening in the headset. The first audio signal may be received by a processor of the headset. The first audio signal may include a source signal and background noise.

In Block 204, a second audio signal is received from a second microphone acoustically coupled to a second opening in the headset. The second opening and the first opening are separated by a first spacing. The first spacing causes a first amplitude and phase difference between the second audio signal and the first audio signal for the source signal. The two microphones sample the source signal (also referred to as a sound signal) at different points along the wavelength of the source signal as governed by the frequency of the sound and the speech of sound in the source signal. Amplitude of the source signal is governed by the inverse square law equating amplitude to distance from the source. Both of these properties, phase and amplitude, may be used to identify the source signal. In one embodiment, the first spacing between the first opening and the second opening is in the range of about 10 millimeters to about 30 millimeters.

In Block 206, a third audio signal is received from a third microphone acoustically coupled to a third opening in an earloop of the headset. The third opening and the second opening are separated by a second spacing. The second spacing creates a second phase and amplitude differences between the third audio signal and the first audio signal for the source signal. The earloop is configured to secure the headset to an ear of a user. The first opening and the third opening may be separated by a third spacing. The third spacing may be about 30 millimeters or more. In one embodiment, the third spacing may be about 40 millimeters.

The openings may each face different directions without affecting the differences in phase and amplitude. The openings sample the sound wave at different points in space resulting in different amplitudes and phases for the source signal. The differences in amplitude may be used by the headset to identify the location of the source (e.g., the mouth of the user of the headset) in combination with the phase differences created by spacings of the openings.

In one embodiment, a fourth audio signal from a fourth microphone acoustically coupled to a fourth opening may be received. The fourth audio signal includes additional phase and amplitude differences for the source signal with respect to the other audio signals and is used to increase the accuracy of the source signal amplification.

In one embodiment, one or more audio signals may be received from a second headset coupled to a second ear of a user. The audio signals from the second headset may be transmitted wirelessly from the second headset to the first headset. The first headset may process the one or more audio signals having additional phase and amplitude differences to increase the accuracy of the source signal amplification.

In Block 208, a source signal is identified using the first phase and amplitude differences and the second phase and amplitude differences. Identification of the source signal may be performed by the processor of the headset with a signal source identification algorithm. The signal source identification algorithm may identify multiple sources of sound signals in the combined audio signals and identify the locations of the sources relative to the location of the headset. The sound source located at the appropriate direction and distance to the headset may be identified as the source signal.

The voice or source signal is identified and separated from the background noise using the multiple microphones and the time difference of arrival. With the different time differences of arrival and the known spacing between the openings, this sound signal may be identified as speech. If sound or noise is captured by each of the microphones all at roughly the same time, this sound or noise may be identified as background noise and not speech from the direction of the mouth of the user. By utilizing three or more microphones, speech of the user (i.e., the desired signal) is more accurately identified by triangulating on the direction of sound. Microphone spacings of between about 10 millimeters and about 30 millimeters may be used to generate sufficient time differences of arrival and phase differences in the signals received by the headset.

In one embodiment, the headset further uses third phase and amplitude differences between the third audio signal and the second audio signal to identify the source signal. In one embodiment, the source signal is identified by further using a fourth audio signal from a fourth microphone of the headset.

In one embodiment, the source signal is identified using three or more audio signals from a second headset. Instead of merely identifying the closest signal to the headset, the headset may identify the closest signal that is between the two headsets.

In Block 210, a gain is applied to amplify the source signal. The gain increases the amplitude of the source signal with respect to the background noise. In one embodiment, the gain is about 20 decibels or more.

In one embodiment, the headset converts the source signal to an electromagnetic signal. The headset may transmit, using an antenna proximate to the earloop, the electromagnetic signal as part of an interactive voice communication.

FIGS. 3, 4, 5, 6, and 7 show embodiments with openings at different locations on a headset. The embodiments shown in FIGS. 3, 4, 5, 6, and 7 may be combined and may include or be included within the features and embodiments described in the other figures of the application. The features and elements of FIGS. 3, 4, 5, 6, and 7 are, individually and as a combination, improvements to personal audio systems. The various features, elements, widgets, components, and interfaces shown in FIGS. 3, 4, 5, 6, and 7 may be omitted, repeated, combined, and/or altered as shown. Accordingly, the scope of the present disclosure should not be considered limited to the specific arrangements shown in FIGS. 3, 4, 5, 6, and 7.

Figure 3:
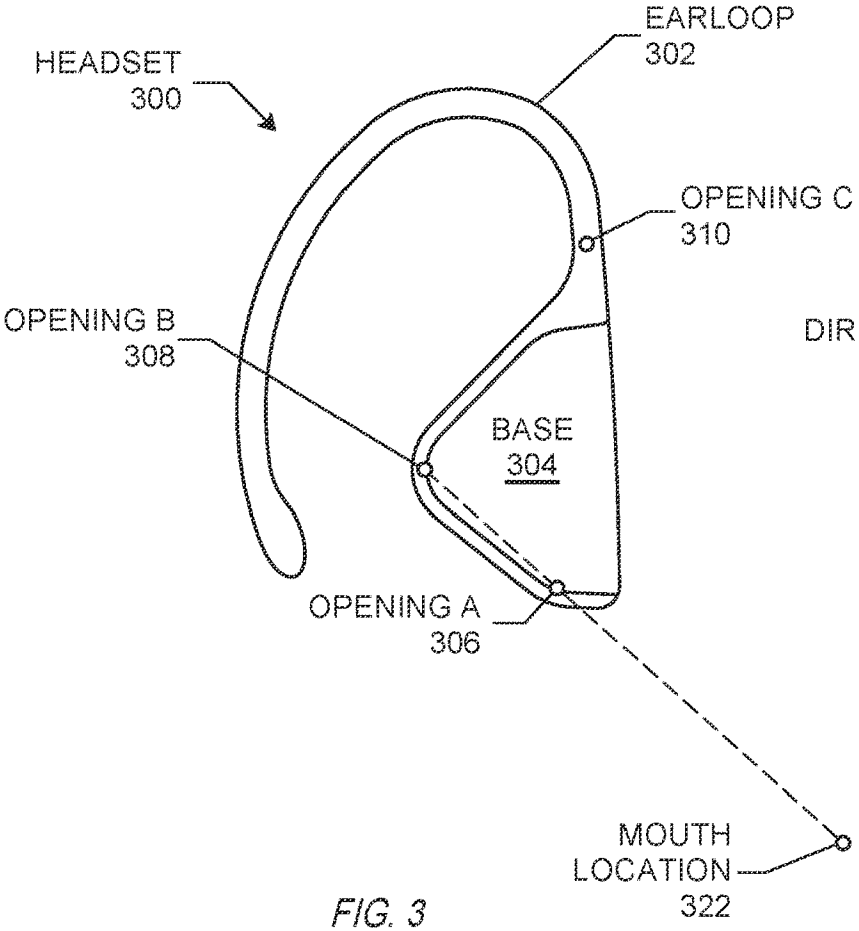

Turning to FIG. 3, the headset (300) includes the earloop (302). The earloop (302) extends from the base (304) and includes the opening C (310) coupled acoustically to one of the microphones in the headset (300). The base (304) includes the openings A (306) and B (308) that are coupled acoustically to additional microphones in the headset (300).

The opening A (306) and the opening B (308) are aligned to form a line that points to the mouth location (322) of a user. The mouth location (322) is the location of the source signal in the sound signals and audio signals received and generated by the headset (300).

The openings A (306) and B (308) are separated by a spacing that may be about 20 millimeters. The openings A (306) and C (310) are separated by a spacing that is greater than the spacing between the openings A (306) and B (308), which may be about 40 millimeters.

The spacings between the openings A (306), B (308), and C (310) create phase and amplitude differences in the sound signals received by the headset (300). The phase and amplitude differences may be identified by the headset and used to determine the location of source signals from the audio signals captured by the headset (300).

Figure 4:
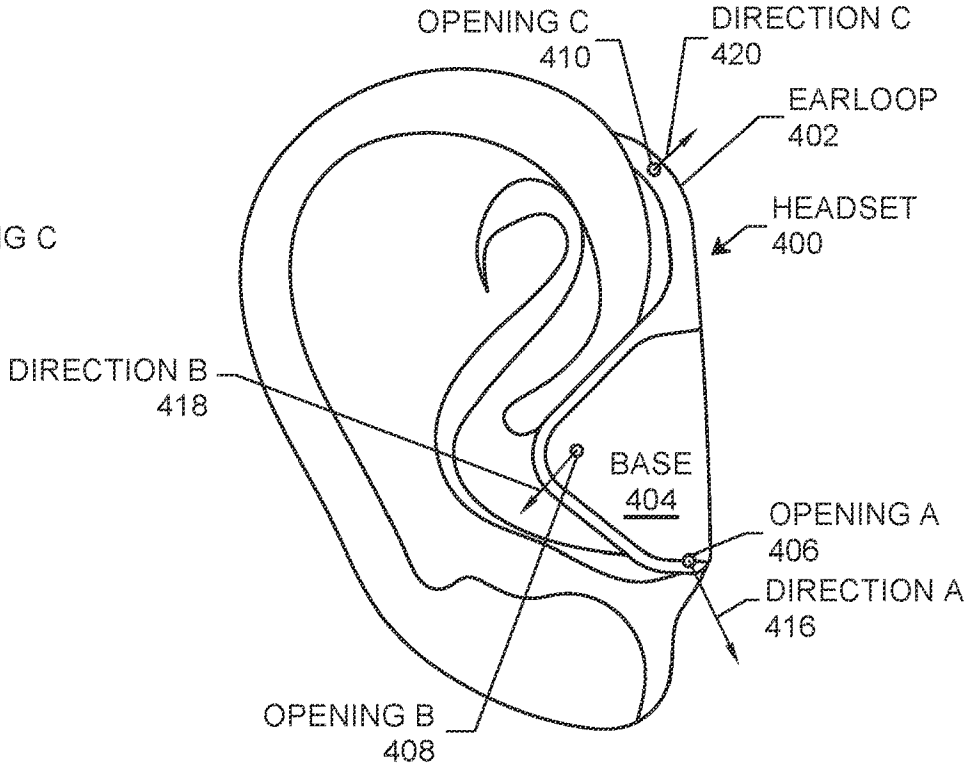
FIG. 3, FIG. 4, FIG. 5, FIG. 6, and FIG. 7 show examples of audio headsets in accordance with disclosed embodiments.

Turning to FIG. 4, the headset (400) includes the earloop (402). The earloop (402) extends from the base (404) and includes the opening C (410) coupled acoustically to one of the microphones in the headset (400). The base (404) includes the openings A (406) and B (408) that are coupled acoustically to additional microphones in the headset (400). The spacings between the openings A (406), B (408), and C (410) create phase and amplitude differences between the audio signals captured by the headset (400).

The openings A (406), B (408), and C (410) respectively face the directions A (416), B (418), and C (420). The sound signal from the users mouth may have a higher amplitude for the opening A (406) than for the opening C (410) due to the different distances from the mouth of the user to the openings A (406) and C (410). The differences in amplitude may be proportional to the differences in the distances from the mouth of the user to the openings A (406), B (408), and C (410).

The headset uses the amplitude differences and the phase differences to identify the source signal in the audio signals captured from the sound signals by the headset (400). Once the source signal for the user is identified, the source signal for the user is preferentially amplified above the background noise.

Figure 5:
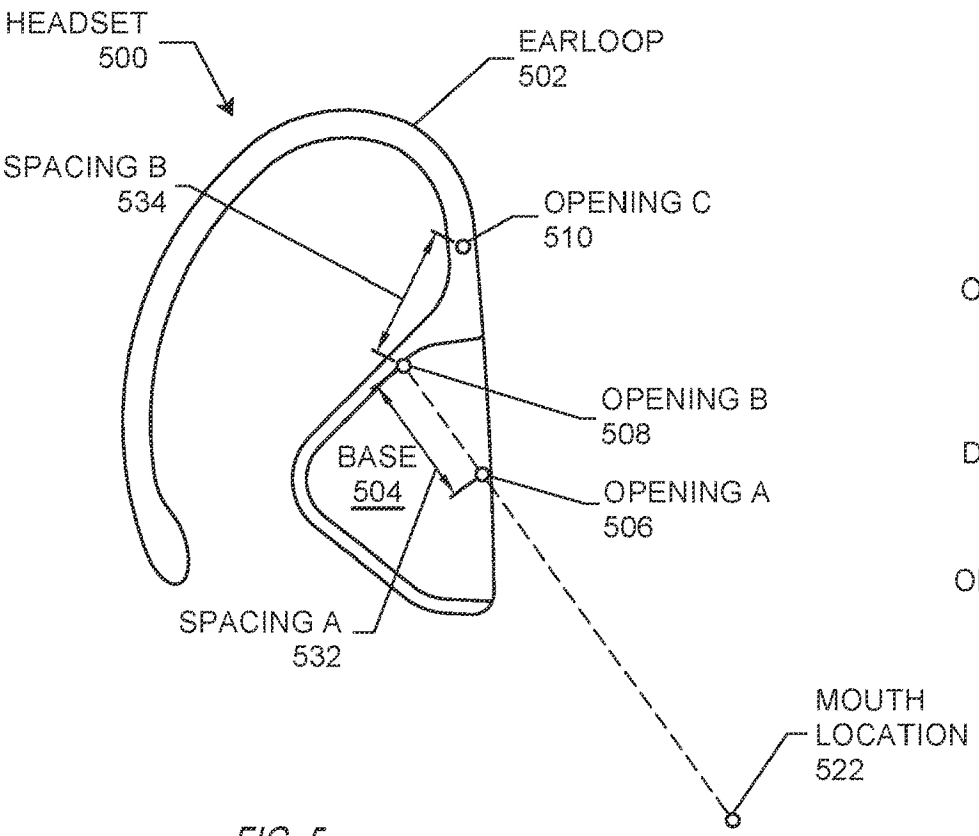

Turning to FIG. 5, the headset (500) includes the earloop (502). The earloop (502) extends from the base (504) and includes the opening C (510) coupled acoustically to one of the microphones in the headset (500). The base (504) includes the openings A (506) and B (508) that are coupled acoustically to additional microphones in the headset (500).

The openings A (506) and B (508) are aligned with the mouth location (522) of the user. The spacing A (532)

between the openings A (506) and B (508) is about the same as the spacing B (534) between the openings B (508) and C (510).

The spacings between the openings A (506), B (508), and C (510) create phase and amplitude differences between the audio signals captured by the headset (500). The phase and amplitude differences are used to identify and amplify the source signal of the speech of the user in the audio signals captured by the headset (500).

Figure 6:
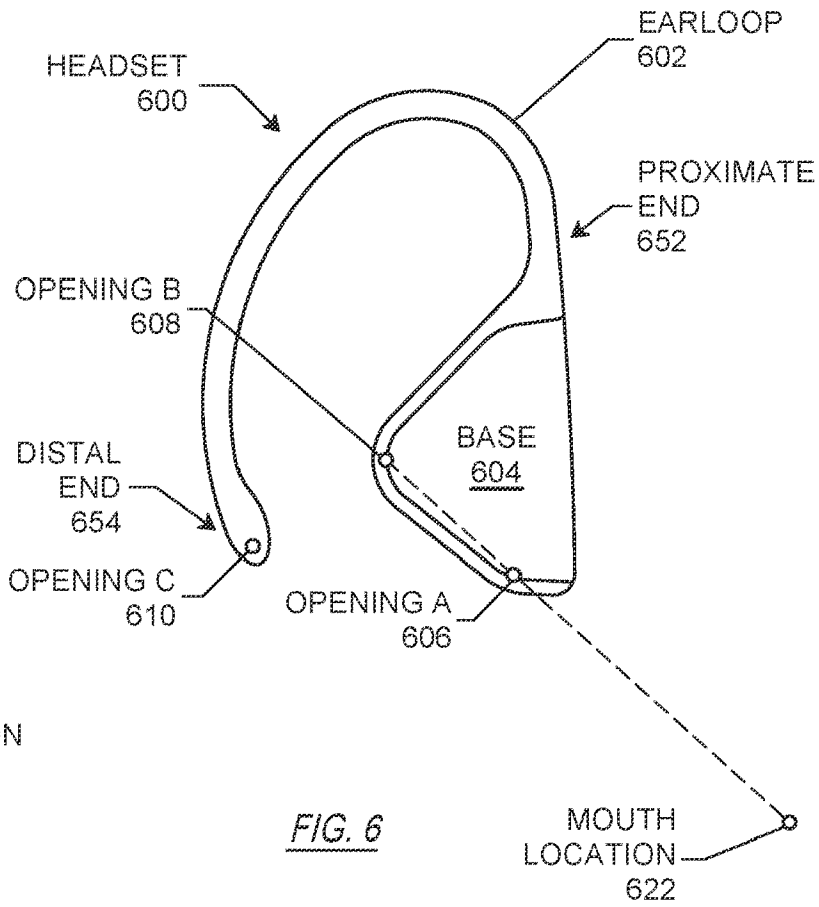

Turning to FIG. 6, the headset (600) includes the earloop (602). The earloop (602) extends from the proximate end (652) formed by the base (604) to the distal end (654). The distal end (654) of the earloop (602) includes the opening C (610) coupled acoustically to one of the microphones in the headset (600). The base (604) includes the openings A (606) and B (608) that are coupled acoustically to additional microphones in the headset (600).

The openings A (606) and B (608) are aligned with the mouth location (622) of the user. The spacings between the openings A (606), B (608), and C (610) create phase and amplitude differences between the audio signals captured by the headset (600).

Figure 7:
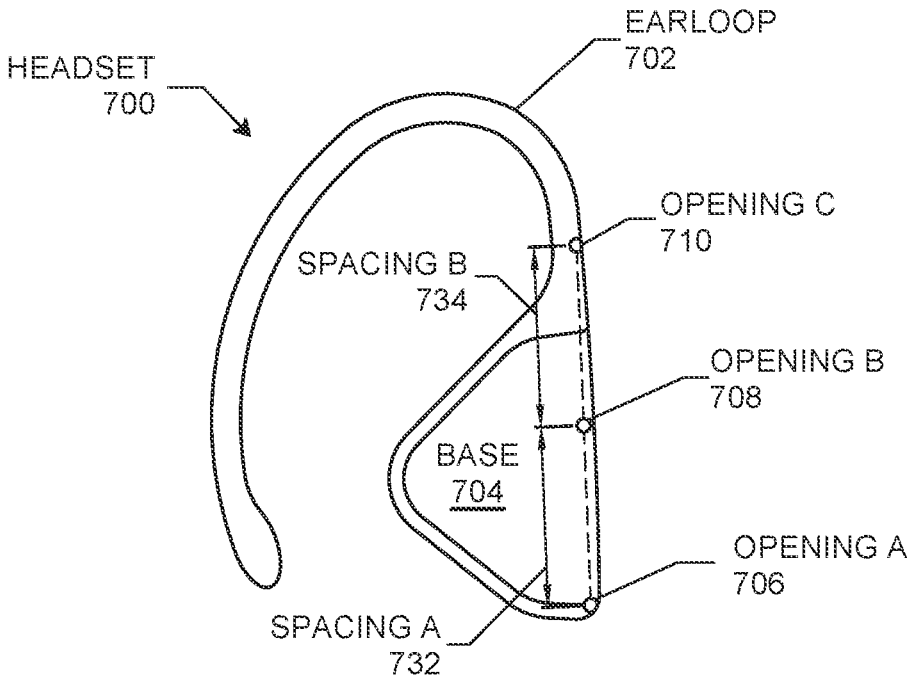

Turning to FIG. 7, the headset (700) includes the earloop (702). The earloop (702) extends from the base (704) and includes the opening C (710) coupled acoustically to one of the microphones in the headset (700). The base (704) includes the openings A (706) and B (708) that are coupled acoustically to additional microphones in the headset (700).

The openings A (706) and B (708) are aligned in a linear vertical arrangement. face. The spacings between the openings A (706), B (708), and C (710) create phase and amplitude differences between the audio signals captured by the headset (700). In one embodiment, the openings A (706), B (708), and C (710) may each face substantially the same direction.

Embodiments of the invention may be implemented on a computing system. Any combination of a mobile, a desktop, a server, a router, a switch, an embedded device, or other types of hardware may be used. For example, as shown in FIG. 8, the computing system (800) may include one or more computer processor(s) (802), non-persistent storage (804) (e.g., volatile memory, such as a random access memory (RAM), cache memory), persistent storage (806) (e.g., a hard disk, an optical drive such as a compact disk (CD) drive or a digital versatile disk (DVD) drive, a flash memory, etc.), a communication interface (812) (e.g., Bluetooth interface, infrared interface, network interface, optical interface, etc.), and numerous other elements and functionalities.

The computer processor(s) (802) may be an integrated circuit for processing instructions. For example, the computer processor(s) (802) may be one or more cores or micro-cores of a processor. The computing system (800) may also include one or more input device(s) (810), such as a touchscreen, a keyboard, a mouse, a microphone, a touchpad, an electronic pen, or any other type of input device.

The communication interface (812) may include an integrated circuit for connecting the computing system (800) to a network (not shown) (e.g., a local area network (LAN), a wide area network (WAN) such as the Internet, a mobile network, or any other type of network) and/or to another device, such as another computing device.

Further, the computing system (800) may include one or more output device(s) (808), such as a screen (e.g., a liquid crystal display (LCD), a plasma display, a touchscreen, a cathode ray tube (CRT) monitor, a projector, or other display device), a printer, an external storage, or any other output device. One or more of the output device(s) (808) may be the same or different from the input device(s) (810). The input and output device(s) (810 and 808) may be locally or remotely connected to the computer processor(s) (802), non-persistent storage (804), and persistent storage (806). Many different types of computing systems exist, and the aforementioned input and output device(s) (810 and 808) may take other forms.

Software instructions in the form of computer readable program code to perform embodiments of the invention may be stored, in whole or in part, temporarily or permanently, on a non-transitory computer readable medium such as a CD, a DVD, a storage device, a diskette, a tape, flash memory, physical memory, or any other computer readable storage medium. Specifically, the software instructions may correspond to computer readable program code that, when executed by a processor(s), is configured to perform one or more embodiments of the invention.

Figure 8:
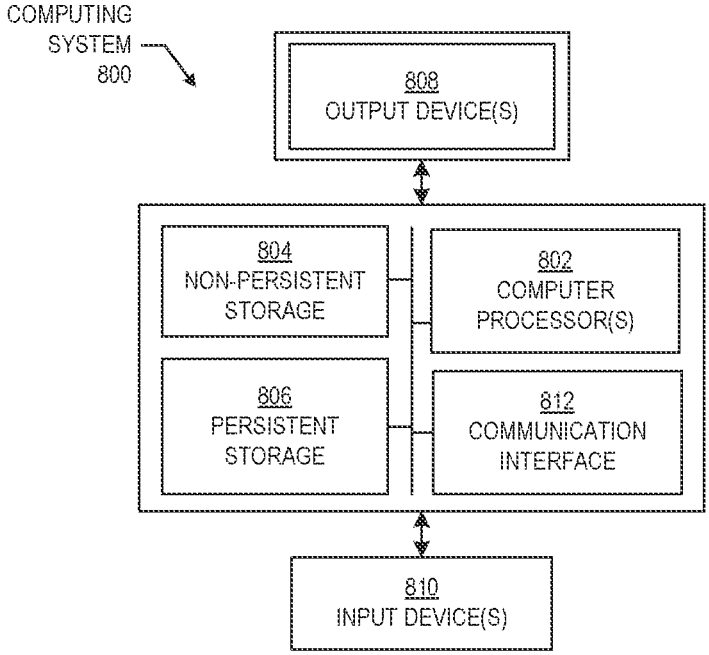
FIG. 8 shows computing systems in accordance with disclosed embodiments.

The computing system (800) of FIG. 8 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions presents only a few examples of functions performed by the computing system (800) of FIG. 8. Other functions may be performed using one or more embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

receiving a first audio signal from a first microphone acoustically coupled to a first opening in a headset;

receiving a second audio signal from a second microphone acoustically coupled to a second opening in the headset, wherein the second opening and the first opening are separated by a first spacing, wherein the first spacing creates first phase and amplitude differences between the second audio signal and the first audio signal, and wherein the first opening and the second opening form a line pointing towards a mouth of a user of the headset;

receiving a third audio signal from a third microphone acoustically coupled to a third opening in an earloop of the headset, wherein the third opening and the second opening are separated by a second spacing and wherein the second spacing creates second phase and amplitude differences between the third audio signal and the first audio signal, wherein the third opening is located at a distal end of the earloop;

identifying a source signal using the first phase and amplitude differences and the second phase and amplitude differences; and applying a gain to amplify the source signal comprising speech of the user.

2. The method of claim 1, further comprising:

converting the source signal to an electromagnetic signal; and transmitting, using an antenna proximate to the earloop, the electromagnetic signal as part of an interactive voice communication.

3. The method of claim 1, wherein the first spacing between the first opening and the second opening is in a range of about 10 millimeters to about 30 millimeters.

4. The method of claim 1, further comprising:

identifying the source signal further using third phase and amplitude differences between the third audio signal and the second audio signal.

5. The method of claim 1, further comprising:

receiving a fourth audio signal from a fourth microphone acoustically coupled to a fourth opening; and identifying the source signal further using the fourth audio signal.

6. The method of claim 1, further comprising:

receiving a fourth audio signal, a fifth audio signal, and a sixth audio signal from a second headset coupled to a second ear of a user; and identifying the source signal further using the fourth audio signal, the fifth audio signal, and the sixth audio signal.

7. The method of claim 1, wherein the first opening and the third opening are separated by a third spacing, and wherein the third spacing is about 30 millimeters or more.

8. The method of claim 1, wherein the first microphone and the second microphone are in line with a source of the source signal.

9. The method of claim 1, wherein the earloop is configured to secure the headset to an ear of a user.

10. The method of claim 1, further comprising:

applying the gain, wherein the gain is about 20 decibels or more.

11. An apparatus comprising:

an earloop;

a processor;

a memory connected to the processor;

a first microphone acoustically coupled to a first opening;

a second microphone acoustically coupled to a second opening, wherein the first opening and the second opening form a line pointing towards a mouth of a user of a headset;

a third microphone acoustically coupled to a third opening in the earloop, wherein the third opening is located at a distal end of the earloop;

program code stored on the memory that, when executed by the processor, is configured for:

receiving a first audio signal from a first microphone acoustically coupled to a first opening in the headset;

receiving a second audio signal from a second microphone acoustically coupled to a second opening in the headset, wherein the second opening and the first opening are separated by a first spacing and wherein the first spacing creates first phase and amplitude differences between the second audio signal and the first audio signal;

receiving a third audio signal from a third microphone acoustically coupled to a third opening in an earloop of the headset, wherein the third opening and the second opening are separated by a second spacing and wherein the second spacing creates second phase and amplitude differences between the third audio signal and the first audio signal;

identifying a source signal using the first phase and amplitude differences and the second phase and amplitude differences; and applying a gain to amplify the source signal comprising speech of the user.

12. The apparatus of claim 11, wherein the program code is further configured for:

converting the source signal to an electromagnetic signal; and transmitting, using an antenna proximate to the earloop, the electromagnetic signal as part of an interactive voice communication.

13. The apparatus of claim 11, wherein the first spacing between the first opening and the second opening is in a range of about 10 millimeters to about 30 millimeters.

14. The apparatus of claim 11, wherein the program code is further configured for:

identifying the source signal further using third phase and amplitude differences between the third audio signal and the second audio signal.

15. The apparatus of claim 11, wherein the program code is further configured for:

receiving a fourth audio signal from a fourth microphone acoustically coupled to a fourth opening; and identifying the source signal further using the fourth audio signal.

16. The apparatus of claim 11, wherein the program code is further configured for:

receiving a fourth audio signal, a fifth audio signal, and a sixth audio signal from a second headset coupled to a second ear of a user; and identifying the source signal further using the fourth audio signal, the fifth audio signal, and the sixth audio signal.

17. The apparatus of claim 11, wherein the first opening and the third opening are separated by a third spacing, and wherein the third spacing is about 30 millimeters or more.

18. The apparatus of claim 11,
wherein the first microphone and the second microphone are in line with a source of the source signal.

19. The apparatus of claim 11,
wherein the earloop is configured to secure the headset to an ear of a user.

20. A headset comprising:
a housing;
an earloop to secure the headset to an ear of a user;
a first microphone acoustically coupled to a first opening in the housing;
a second microphone acoustically coupled to a second opening in the housing, wherein the first opening and the second opening form a line pointing towards a mouth of a user of the headset; and
a third microphone acoustically coupled to a third opening in the earloop, wherein the third opening is located at a distal end of the earloop.

* * * * *